United States Patent [19]

Fukui et al.

[11] 4,283,234

[45] Aug. 11, 1981

[54] GAS TURBINE NOZZLE

[75] Inventors: Yutaka Fukui; Hiromi Kagohara, both of Hitachi, Japan

[73] Assignee: Hitachi, Ltd., Tokyo, Japan

[21] Appl. No.: 102,828

[22] Filed: Dec. 12, 1979

[30] Foreign Application Priority Data

Dec. 15, 1978 [JP] Japan ..... 53-157234

[51] Int. Cl.[3] ..... C22C 19/05

[52] U.S. Cl. ..... 148/32.5; 75/134 F; 75/171; 148/158; 148/162

[58] Field of Search ..... 148/32, 32.5, 158, 162; 75/171, 134 F

[56] References Cited

U.S. PATENT DOCUMENTS 3,865,581 2/1975 Sekino et al. ..... 75/171

*Primary Examiner*—R. Dean

*Attorney, Agent, or Firm*—Craig and Antonelli

[57] ABSTRACT

A gas turbine nozzle made of a cast material having a chemical composition which contains 0.2 to 1 wt% carbon, 0.1 to 2 wt% silicon, 0.1 to 2 wt% manganese, 20 to 40 wt% chromium, 0.001 to 0.1 wt% boron, 5 to 20 wt% of at least one of tungsten and molybdenum and the remainder nickel. The material can contain at least one of carbide former which forms MC type carbides, e.g. titanium, niobium, hafnium, tantalum, zirconium and vanadium. The content of the carbide formers is between 0.1 and 2 wt%. Further, the material can contain 0.005 to 2 wt% of at least one of yttrium and aluminum. The material has a heat-treated structure in which eutectic carbides and secondary carbides are dispersed. The gas turbine nozzle made of this cast material exhibits a strength against thermal shock greater than that of conventional gas turbine nozzle made of a cobalt base alloy. Also, corrosion resistance, creep rupture strength, rupture strength and reduction of area are equivalent to or greater than those of the conventional gas turbine nozzle.

13 Claims, 12 Drawing Figures x 400 x 400

GAS TURBINE NOZZLE

BACKGROUND OF THE INVENTION

1. Field of the Invention

The present invention relates to a gas turbine nozzle and, more particularly, to a gas turbine nozzle made of a nickel base alloy.

2. Description of the Prior Art

The nozzles of a gas turbine is subjected to a corrosive gas of a high temperature, during operation of the gas turbine. This corrosive gas is a product of combustion of a fuel such as heavy oil, and is heated to a high temperature of around 1,100° C. This gas contains various highly corrosive elements such as sulfur, sodium, kalium and the like. It is, therefore, necessary that the gas turbine nozzle be made of a material having a high corrosion resistance.

Also, the nozzle is subjected to heating and cooling alternately and repeatedly, due to repetitional operation and suspension of the gas turbine. Therefore, another requisite for the material of gas turbine nozzle is to have a high resistance against thermal shock and thermal fatigue.

Conventionally, cobalt base alloys have been used as the material of the gas turbine nozzle. A typical one of these cobalt base alloy has a chemical composition constituted by 0.28 wt% carbon, 10 wt% nickel, 30 wt% chromium, 1.8 wt.% iron, 7 wt% tungsten, 0.014 wt% boron and the remainder cobalt.

The conventional gas turbine nozzle of the cobalt base alloy is fabricated by a precision casting and is subjected, after the casting, to a heat treatment, i.e. solution heat treatment and aging treatment. The gas turbine nozzle made of a cobalt base alloy exhibits a superior corrosion resistance against the corrosive combustion gas, as well as various advantages such as high creep rupture strength, large rupture strength, large reduction of area upon rupture and small aging embrittlement. On the other hand, however, the gas turbine nozzle made of a cobalt base alloy is liable to exhibit a cracking due to the repeated heating and cooling, requiring frequent repair by welding. The life of the gas turbine nozzle made of a cobalt base alloy, therefore, has a short life, even by the repeated repair by welding. In addition, the cost of production of the gas turbine nozzle is inevitably raised due to the use of expensive cobalt.

SUMMARY OF THE INVENTION

Object of the Invention

It is, therefore, a major object of the invention to provide a gas turbine nozzle made of a material which does not contain cobalt as the base but exhibits superior characteristics compared with those of the cobalt base alloy.

It is another object of the invention to provide a gas turbine nozzle which has a higher strength against thermal shock than that made of cobalt base alloy.

It is still another object of the invention to provide a gas turbine nozzle made of a material which can be molten in the atmosphere and which permits precision casting in the atmosphere.

Statement of the Invention

According to the invention, there is provided a gas turbine nozzle made of an alloy containing 0.2 to 1 wt% carbon, 0.1 to 2 wt% silicon, 0.1 to 2 wt% manganese, 20 to 40 wt% chromium, 0.001 to 0.1 wt% boron, 5 to 20 wt% of at least one of tungsten and molybdenum and the remainder nickel.

The gas turbine nozzle is fabricated by a precision casting from this nickel base alloy and subsequent solution heat treatment and aging treatment. The structure after the aging treatment contains eutectic carbides and secondary carbides which are dispersed in a matrix of austenite. The secondary carbides are of $M_{23}C_6$ type precipitated as a result of the aging treatment. The eutectic carbides are also of $M_{23}C_6$ type.

The gas turbine nozzle of the invention exhibits a superior strength against thermal shock compared with the conventional gas turbine nozzle made of cobalt base alloy. In addition, corrosion resistance against combustion gas, creep rupture strength, rupture elongation and reduction of area at rupture are equivalent to or greater than those of the conventional gas turbine nozzle made of a cobalt base alloy. It is also advantageous that the gas turbine nozzle of the invention can be produced by melting and precision casting in the atmosphere.

The gas turbine nozzle of the invention is made of a material which can contain at least one of elements forming MC type carbides, such as titanium, niobium, hafnium, tantalum, zirconium, and vanadium, by an amount which falls between 0.1 to 2 wt% in total. By containing these carbide formers, it is possible to disperse the secondary carbides uniformly to improve the creep rupture strength, rupture elongation, and reduction of area at rupture. In addition, the strengths against thermal shock and thermal fatigue are increased.

The material of gas turbine nozzle of the invention can contain at least one of yttrium and aluminum, each by 0.05 to 2 wt%. These elements are effective in improving the corrosion resistance of the alloy against the combustion gas.

The material also can contain 5 to 15 wt% of cobalt. The cobalt content provides a remarkable improvement in the creep rupture strength and effectively suppresses the aging embrittlement.

The gas turbine nozzle of the invention can be fabricated by a precision casting which is conducted, for example, in a manner shown below.

First of all, a female mold is formed making use of a metallic pattern, and wax is injected into the female pattern. After the removal of the female pattern, a moldwash is applied to the surface of the wax and sand is scattered on the moldwash. The application of the moldwash and the scattering of the sand are repeated several times and, thereafter, the wax is removed by melting. Subsequently, the sand is fired to become a mold into which a melt of nickel base alloy molten in the atmosphere or under a vacuum is poured. After the solidification of the nickel base alloy, the mold is broken to permit the taking out of the cast nozzle.

The gas turbine nozzle thus fabricated by a precision casting then undergoes an examination for detecting any defect caused during casting. If any, suitable measure such as welding, repair or the like is taken before the cast nozzle is subjected to the heat treatment. The heat treatment consists of a solution heat treatment and aging treatment.

After the heat treatment, a machining is effected on the nozzle to finish the nozzle surface, thus completing the fabrication of the gas turbine nozzle.

Some of the nickel base alloy are strengthened by precipitation of intermetallic compound $Ni_3$ (Al, Ti)

caused by an aging treatment. Such alloys, however, cannot be used as the material for gas turbine nozzle, because they are liable to cause crackings due to poor ductility and less resistant to thermal fatigue. Also, these alloys have poor weldability so that weld cracks are formed when the crackings are repaired by welding. Further, these alloys have inferior corrosion resistance. In addition, since these alloys contain large amount of titanium and aluminium which are liable to be oxidized, the melting and precision casting have to be made under a vacuumed condition. This inconveniently limits the size of the gas turbine nozzle produced, and permits the production of only small-sized gas turbine nozzle.

The gas turbine nozzle of the invention permits the melting of the material and the precision casting under atmospheric pressure and, therefore, can have a large variety of sizes in gas turbine nozzle. According to the invention, the chemical composition of the material is selected as stated before, for the reasons stated below.

C: 0.2 to 1 wt%

The carbon is necessary for maintaining the high temperature creep rupture strength equivalent to that of conventional cobalt base alloy. A carbon content less than 0.2 wt% causes a brittle $\sigma$ phase which is an intermetallic compound expressed by $(Cr, Mo)_x(Ni, Co)_y$ to make the creep rupture strength smaller than that of the conventional cobalt base alloy. To the contrary, a carbon content in excess of 1 wt% promotes the growth of the carbides during the use to make the structure coarse resulting in an aging embrittlement. Preferably, the carbon content falls between 0.4 and 0.6 wt%.

Si: 0.1 to 2 wt%

Silicon is added as a deoxidizer. Deoxidization is insufficient if the silicon content is less than 0.1 wt% to cause generation of pores and cavities. A silicon content exceeding 2 wt% will promote the precipitation of the $\sigma$ phase to make the alloy brittle.

Mn: 0.1 to 2 wt%

Manganese is added also as a deoxidizer. The manganese content is limited to fall between 0.1 and 2 wt% for the same reason as that in the case of silicon.

Cr: 20 to 40 wt%

Chromium permits the formation of eutectic carbides and secondary carbides which in combination ensure greater creep rupture strength and reduction of area than those of the conventional cobalt base alloy. The alloy is made less resistant to corrosion by combustion gas if the chromium content comes down below 20 wt%. Also, a chromium content exceeding 40 wt% causes excessive generation of carbides and $\sigma$ phase to make the alloy brittle. The chromium content preferably falls within the range between 25 and 35 wt%.

B: 0.001 to 0.1 wt%

Boron is added to improve the creep rupture strength and ductility at high temperature. No substantial effect is produced by boron content less than 0.001 wt%, while a boron content in excess of 0.1 wt% inconveniently deteriorates the weldability particularly in Tungsten Inert Gas Arc Welding. As a result, crackings are liable to be formed in the welded parts when defects in the nozzle surface are repaired by welding.

At least one of W and Mo: 5 to 20 wt%

The tungsten and/or molybdenum is added to strengthen the matrix. For achieving a sufficient strengthening, it is essential that the content of each of these element is not smaller than 5 wt%. On the other hand, content in excess of 20 wt% will permit the generation of the $\sigma$ phase to lower the high-temperature creep rupture strength.

Elements for forming MC type carbides: 0.1 to 2 wt%

The elements for forming MC type carbides are, for example, titanium, niobium, tantalum, vanadium and so forth. These elements promotes a uniform dispersion of the secondary carbides to further enhance the strength and ductility. The amounts of these elements should be 0.1 to 2 wt% in total. A total content less than 0.1 wt% cannot provide appreciable effect. To the contrary, a total content in excess of 2 wt% deteriorates the strength because most of the carbon is consumed by MC type carbides to hinder the precipitation of $M_{23}C_6$ type carbides. The total content of these elements is preferably between 0.1 and 4.5 times as large as that of carbon content. Experiments showed that titanium and vanadium contain some problems concerning casting surface and corrosion resistance, while tantalum and hafnium are not recommended from economical point of view. The best result was obtained with zirconium or niobium.

At least one of Y and Al: 0.05 to 2 wt%

By containing at least one of yttrium and aluminum, the alloy can have increased corrosion resistance. A remarkable effect is produced when the content exceeds 0.05 wt%. A content in excess of 2 wt%, however, causes a deterioration of weldability to make it difficult to repair cracking in the nozzle surface by welding.

Co: 5 to 15 wt%

Cobalt is contained to strengthen the matrix. The creep rupture strength at high temperature is remarkably improved by cobalt content exceeding 5 wt%. Also, aging embrittlement is suppressed by this cobalt content. These effect, however, are saturated when the cobalt content is increased beyond 15 wt%. A further increase of the cobalt content is not preferred from economical point of view.

It is remarkable that the gas turbine nozzle of the invention ensures a life which is more than 1.5 times as long as that of the conventional gas turbine nozzle made of a cobalt base alloy.

EXAMPLES

EXAMPLE 1

Figure 1:
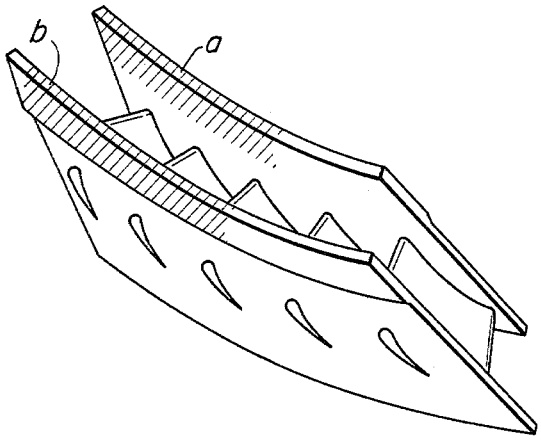
FIG. 1 is a perspective view of a part of gas turbine nozzle embodying the present invention.

FIG. 1 shows a section of a gas turbine nozzle fabricated by a precision casting. A plurality of sections are connected in a ring-like manner to form a turbine nozzle. A plurality of gas turbine nozzle sections as shown in FIG. 1 were produced from various nickel base and cobalt base alloys having chemical compositions as shown in Table 1. These nozzle sections were then subjected, after the heat treatment, to a creep rupture test and thermal shock test. The heat treatment consisted of a solution heat treatment and aging treatment. More specifically, the solution heat treatment was conducted by heating the nozzle sections at 1150° C. for 4 hours and then cooling them in the furnace, while the aging treatment was carried out by heating the nozzle sections at 980° C. for 4 hours and then cooling them in the air.

The alloys of Nos. 1 to 5 in Table 1 were molten at 1600° C. in the atmosphere and cast also in the atmosphere.

The creep rupture test was carried out at 982° C. Also, the thermal shock test was executed using test pieces having V-shaped notch, by repeatedly moving the test pieces between a furnace of 982° C. and a vessel containing water. The period of one cycle of movement was 6 minutes and the number of repetition was 200.

Test pieces were cut out from the portions a and b shown in FIG. 1.

Figure 2:
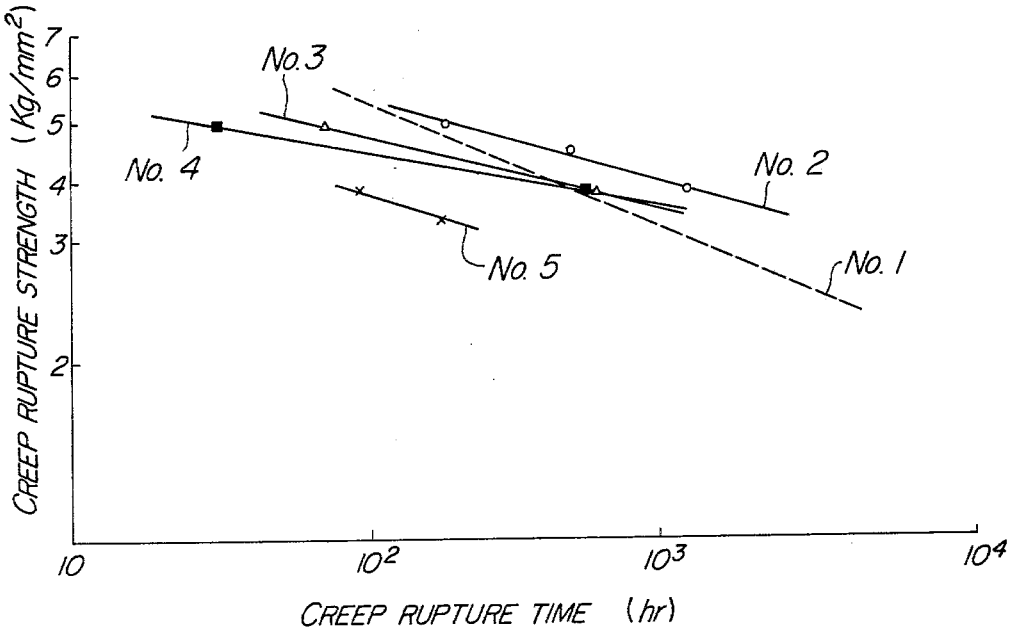
FIG. 2 is a graph showing the relationship between the creep rupture strength and creep rupture time.

FIG. 2 shows the relationship between the creep rupture strength and the time till rupture. It will be seen from FIG. 2 that the test piece No. 2 having a zirconium content of 0.5 wt% exhibits a higher creep rupture strength than the test piece No. 1 made of a cobalt base alloy, and that the test pieces Nos. 3 and 4 having zirconium contents of 1 wt% and 2 wt%, respectively, show higher rupture strengths than the test piece No. 1 made of the cobalt base alloy, when the creep rupture time is long. From this test, it is understood that the aging embrittlement is suppressed by containing zirconium which is an element forming MC type carbides.

Figure 3:
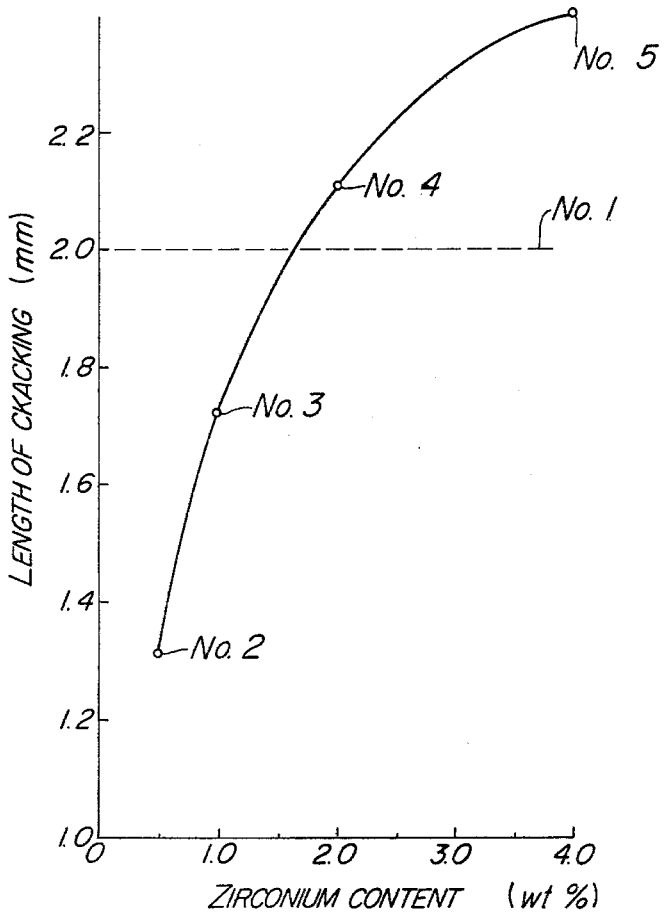
FIG. 3 is a graph showing the relationship between the length of cracking and the zirconium content of the nickel base alloy observed in a heat cycle test.

FIG. 3 shows the relationship between the length of cracking and the zirconium content of the alloy as observed in the thermal shock test. The cracking length in the cobalt base test piece No. 1 is shown by btoken line in this Figure. The test pieces Nos. 2 and 3 having zirconium contents of 0.5 wt% and 1 wt%, respectively, exhibit smaller cracking length than the cobalt base test piece No. 1, while test pieces Nos. 4 and 5 show larger cracking length than the cobalt base alloy test piece No. 1. The cracking length of the test piece No. 4 having a zirconium content of 2 wt%, however, is materially identical to that of the test piece No. 1.

Judging from the results of the creep rupture test ano thermal shock test shown in FIGS. 2 and 3, it is recommended that the zirconium content is not greater than 2 wt%.

TABLE 1

| | Chemical composition (wt %) | | | | | | | | | |
|---|---|---|---|---|---|---|---|---|---|---|
| No. | C | Si | Mn | Cr | W | B | Zr | Ni | Fe | Co |
| 1 | 0.28 | 1.5 | 1.5 | 30 | 7 | 0.014 | — | 10 | 1.8 | (*) |
| 2 | 0.45 | " | " | 27 | 9 | 0.012 | 0.5 | (*) | — | — |
| 3 | " | " | " | " | " | " | 1.0 | " | — | — |
| 4 | " | " | " | " | " | " | 2.0 | " | — | — |
| 5 | " | " | " | " | " | " | 4.0 | " | — | — |

(*) balance

TABLE 2

| | Chemical composition (wt %) | | | | | | | | | | | | | | | |
|---|---|---|---|---|---|---|---|---|---|---|---|---|---|---|---|---|
| No. | C | Si | Mn | Cr | W | Mo | B | Zr | Nb | Ta | Hf | Ti | Y | Al | Ni | Co |
| 6 | 0.25 | 1.0 | 1.0 | 28 | 7.0 | — | 0.01 | — | — | — | — | — | — | — | — | (*) |
| 7 | 0.11 | 0.5 | 0.5 | 15 | 2.5 | 3.0 | — | 1.0 | — | — | — | 3.5 | — | 3.5 | (*) | 10 |
| 8 | 0.40 | 1.5 | 1.5 | 25 | 10.0 | 7.0 | 0.01 | — | — | — | — | — | — | — | " | — |
| 9 | " | " | " | " | " | " | " | 0.2 | — | — | — | — | — | — | " | — |
| 10 | " | " | " | " | " | " | " | 0.5 | — | — | — | — | — | — | " | — |
| 11 | " | " | " | " | " | " | " | 2.0 | — | — | — | — | — | — | " | — |
| 12 | " | " | " | " | " | " | " | — | 0.25 | — | — | 0.25 | — | — | " | — |
| 13 | " | " | " | " | " | " | " | 0.5 | 0.25 | 0.5 | — | 0.25 | — | — | " | — |
| 14 | " | " | " | " | " | " | " | 1.0 | — | — | 0.5 | — | — | — | " | — |
| 15 | " | " | " | " | " | " | " | — | — | — | — | — | 0.5 | 0.5 | " | — |
| 16 | " | " | " | " | " | " | " | 0.5 | — | — | — | — | 0.5 | — | " | — |
| 17 | " | " | " | " | " | " | " | — | — | 0.5 | — | — | 0.5 | 0.5 | " | — |
| 18 | " | " | " | " | " | " | " | 0.5 | 0.25 | 0.5 | — | 0.25 | — | — | " | — |
| 19 | " | " | " | " | " | " | " | — | 0.25 | — | — | 0.25 | — | — | " | 10 |
| 20 | " | " | " | " | " | " | " | 0.5 | — | — | 0.5 | — | 0.5 | 0.5 | " | 10 |
| 21 | " | " | " | " | " | " | " | — | 0.25 | — | — | — | — | — | " | — |
| 22 | " | " | " | " | " | " | " | 0.25 | 0.25 | — | — | — | 0.3 | 0.2 | " | — |
| 23 | " | " | " | " | " | " | " | — | — | — | — | — | — | — | " | 10 |
| 24 | " | " | " | " | " | " | " | — | — | — | — | — | 0.3 | 0.2 | " | 10 |

(*) balance

EXAMPLE 2

Nickel base and cobalt base alloy test pieces having chemical compositions shown in Table 2 were produced by precision casting. The test piece had a size of 100 mm × 200 mm × 15 mm. The test piece No. 6 is made of a cobalt base alloy while the test piece No. 7 is made of a material which has been strengthened by a precipitation of an intermetallic compound of $Ni_3$ (Al, Ti). Only the test piece No. 7 was produced by melting and precision casting under vacuumed condition, while other test pieces were molten and cast in the atmosphere. The test pieces were subjected, after the casting, to a solution heat treatment at 1150° C. for 4 hours and an aging treatment at 982° C. for four hours.

Figure 4:
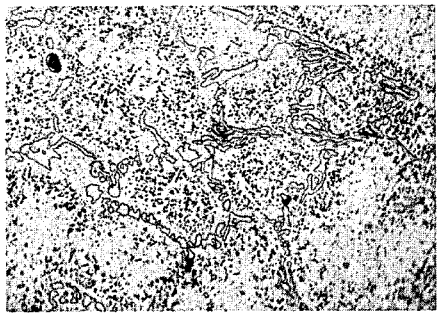
FIG. 4 is a microscopic photograph (magnification 400) of a test piece of specimen No. 8.
Figure 5:
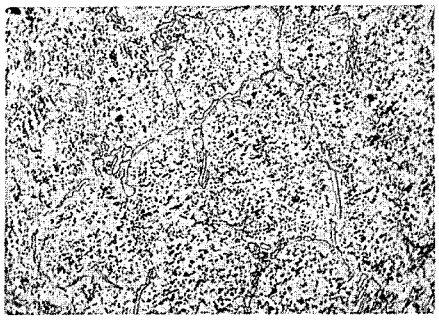
FIG. 5 is a microscopic photograph (magnification 400) of a test piece of specimem No. 10.

Existence of eutectic carbides and secondary carbides were observed in all of the test pieces Nos. 8 to 24. The microscopic photographs of structures of the test pieces Nos. 8 and 10 are shown in FIGS. 4 and 5, respectively. The magnification was 400 in each case. The test piece No. 8 which do not contain elements forming MC type carbides exhibits a concentration of granular secondary carbides precipitated around the grain boundaries of austenite matrix. In contrast to the above, the test piece No. 10 which contains elements forming MC type carbides exhibits a uniform dispersion of secondary carbides over the entire area of the austenite matrix. The lump-like substances observed in FIGS. 4 and 5 are the eutectic carbides.

The test pieces shown in Table 2 were subjected to a creep rupture test, thermal fatigue test and a thermal shock test.

Figure 6:
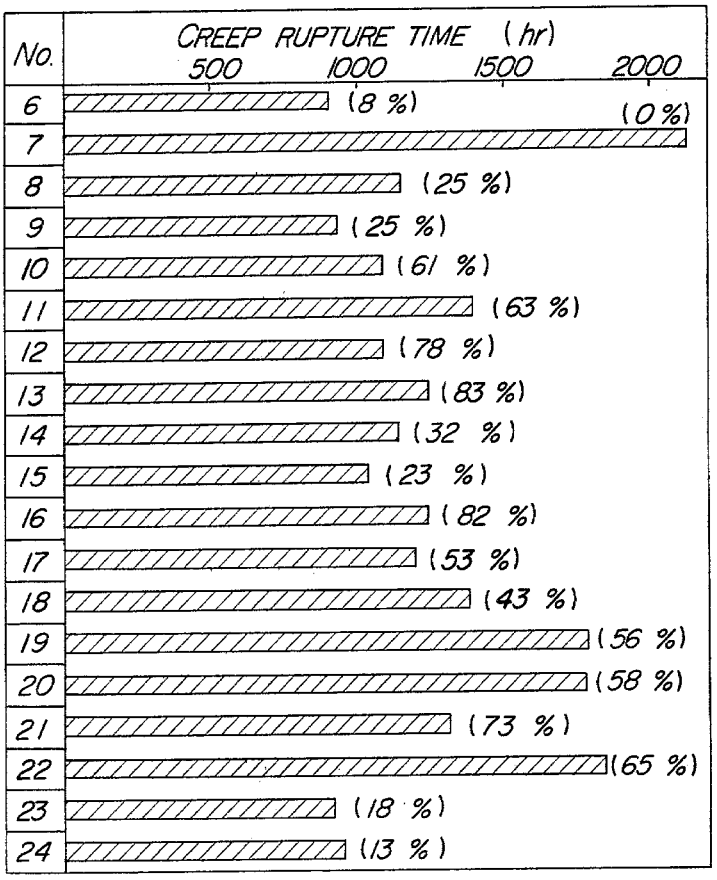
FIG. 6 is a graph showing the result of a creep rupture test.

More specifically, the creep rupture test was executed with test pieces of 60 mm$\phi\times$30 mml, at 982° C. under application of a stress of 3.0 kg/mm$^2$, except the test piece No. 7 which was tested under a stress of 6.0 kg/mm$^2$. FIG. 6 shows the creep rupture time and the reduction of area at rupture. The reduction of area is shown by numerals in the bracket ( ).

It is clear from FIG. 6 that the test pieces Nos. 8 to 24 have creep rupture time equivalent to or longer than that of the test piece No. 6 made of the cobalt base alloy, and greater reduction of area than that of the latter.

The test piece No. 7, which is strengthened by the precipitation of $Ni_3(Al, Ti)$, has the longest creep rupture time. However, this test piece has an extremely small reduction of area which is substantially 0 (zero)%. This means that this material has a poor ductility.

One of the factors for obtaining a long life of the gas turbine nozzle is to suppress the aging embrittlement of the nozzle material. Whether the material is liable to exhibit an aging embrittlement or not is known to some extent from the creep rupture test. Generally, the materials exhibiting long rupture time, greater rupture elongation and greater reduction of area are less liable to show the aging embrittlement. From this point of view, it is clear that the test pieces Nos. 8 to 24, which have longer rupture time and greater reduction of area than the test piece No. 6, are less liable to show aging embrittlement. The thermal fatigue test was conducted by heating cylindrical test pieces having inside and outside diameters of 10 mm and 13 mm up to 982° C. and applying alternately a tensile stress of 15 Kg/mm$^2$ and a compression stress of 10 Kg/mm$^2$ to the test pieces, while the thermal shock test was executed by repeatedly moving test pices having a diameter and length of 10 mm and 10 mm between a furnace maintained at 982° C. and a vessel containing water. The period of one cycle of movement was 6 minutes. Table 3 shows the result of the thermal fatigue test, i.e. the number of cycles repeated till the rupture, conducted with some of the test pieces of the materials shown in Table 2.

TABLE 3

| No. | number of cycles repeated till rupture |
|---|---|
| 6 | 1350 |
| 7 | 873 |
| 9 | 1382 |
| 10 | 2564 |
| 11 | 2627 |
| 16 | 3820 |
| 17 | 3134 |
| 18 | 3233 |
| 20 | 4250 |

The test pieces Nos. 9 to 20, which showed greater number of cycles than the cobalt base alloy test piece No. 6 clearly have larger strengths against thermal fatigue than the test piece No. 6. The smaller number of cycles as observed with the test piece No. 7 is attributable to the poor ductility which will be seen from FIG. 6.

Figure 7:
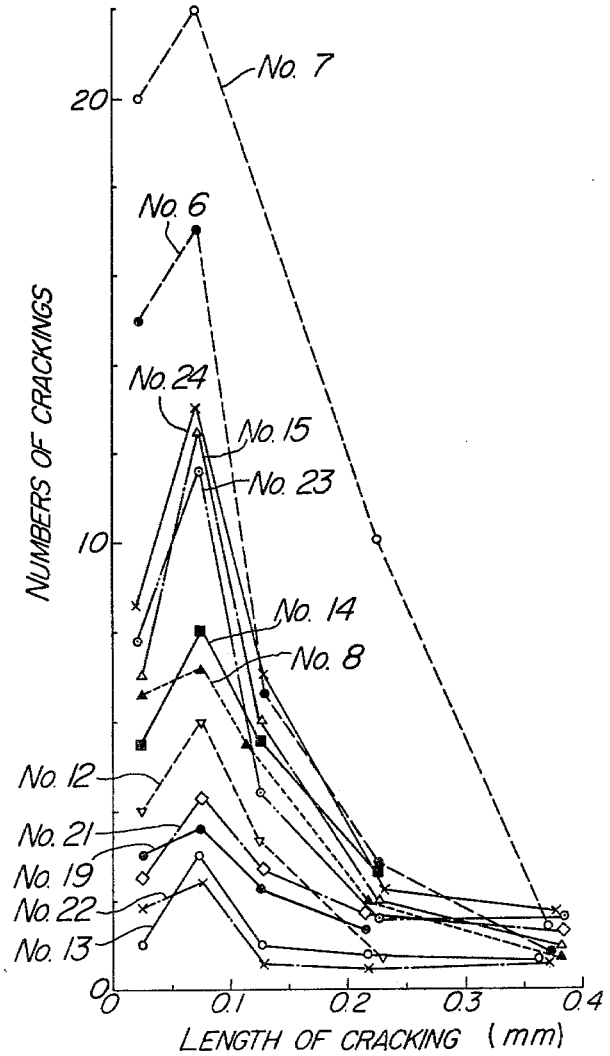
FIG. 7 is a graph showing the relationship between the number of crackings and length of crackings as observed in a thermal shock test.

FIG. 7 shows the result of the thermal shock test. More specifically, the relationship between the length of crackings and the number of crackings as observed after 200 cycles of thermal shock is shown in FIG. 7.

The test pieces of nickel base alloys strengthened by eutectic carbides and secondary carbides clearly have superior strength against thermal shock to those of test pieces Nos. 6 and 7 having no strengthening eutectic carbides and secondary carbides.

As a result of these tests, it was confirmed that the gas turbine nozzle of the invention has larger strength against thermal fatigue and thermal shock, as well as smaller aging embrittlement, than those of the conventional gas turbine nozzle made of a cobalt base alloy.

The test piece No. 20 was repaired, after the thermal shock test, by pad welding in accordance with tungsten inert gas welding method. No weld cracking was caused as a result of this welding.

Figure 8:
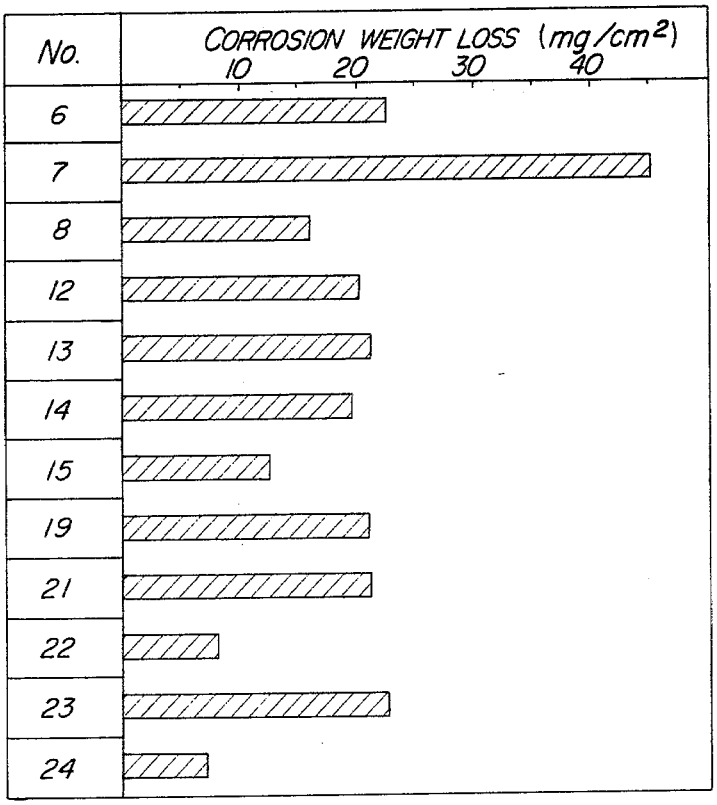
FIG. 8 is a graph showing the result of a high-temperature corrosion test.

In order to evaluate the corrosion resistance against the combustion gas, powders consisting of 75 wt% $Na_2SO_4$ and 25 wt% NaCl were applied to the surface of test pieces each having a diameter and length of 10 mm and 10 mm. The test pieces were then heated at 750° C. for 500 hours and corrosion weight loss of each material was measured. The result of this test was shown in FIG. 8. From this Figure, it will be seen that the test pieces of the gas turbine nozzle materials in accordance with the invention has corrosion resistances equivalent to or greater than that of the cobalt base alloy test piece No. 6. Particularly, the alloys containing at least one of yttrium and aluminum showed superior property. The test piece No. 7, which is strengthened by precipitation of $Ni_3(Al, Ti)$ is quite inferior also in this respect.

EXAMPLE 3

Alloys having the following contents were produced by a melting and casting under atmosphere: 0.5 wt% carbon, 1.5 wt% silicon, 1.5 wt% manganese, 10 wt% tungsten, 0.001 wt% boron, 0.5 wt% yttrium and the remainder chromium and nickel. This material was subjected to a solution heat treatment at 1150° C. for four hours and an aging treatment at 982° C. for four hours. After these treatments, the material was subjected to a test for examining the strength against thermal fatigue under a corrosive environment.

As is well known, a large stress is produced in the nozzle of the gas turbine during the operation of the latter. More specifically, a tensile stress of about 15 Kg/mm$^2$ and a compression stress of about 10 Kg/mm$^2$ are repeatedly generated in the gas turbine nozzle. Also, the gas turbine undergoes the corrosion effected by $Na_2SO_4$, NaCl, $O_2$ and the like.

Powders of 99 wt% $Na_2SO_4$ and 1 wt% NaCl were applied to the surface of a test piece having a diameter and length of 10 mm each. The test piece was then heated up to 1000° C. in an atmosphere into which 0.1 wt% $SO_2$-76 wt% $O_2$-$N_2$ gas was introduced. During the heating, tensile force and compression force were applied to the test piece to generate a tensile stress of 15 Kg/mm$^2$ alternately in the test piece.

Figure 9:
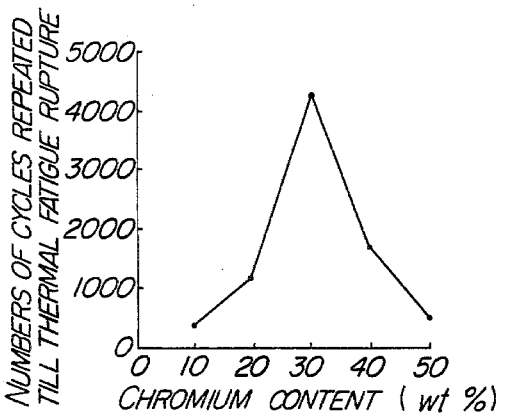
FIG. 9 is a graph showing the relationship between the number of cycles repeated till rupture and the chromium content of the nickel base alloy as observed in a thermal fatigue test.

FIG. 9 shows the relationship between the number of cycles repeated till rupture and the chromium content, as observed in this test. A remarkable effect was shown particularly when the chromium content falls within the range between 20 and 40 wt%. Usually, in the 5-year design of the gas turbine nozzle, the number of expected cycle is about 3,000. This can be fulfilled by an alloy having a chromium content of between 25 and 35 wt%.

EXAMPLE 4

The same test as that made in Example 3 was executed with alloy materials containing 1.5 wt% silicon, 1.5 wt% manganese, 0.001% boron, 1.0 wt% zirconium, 10 wt% tungsten, 0.5 wt% yttrium, 30 wt% chromium and the remainder carbon and nickel. The test piece was produced by melting and casting in the atmosphere, and was then subjected to a solution heat treatment at 1150° C. for four hours and an aging treatment at 982° C. for four hours.

Figure 10:
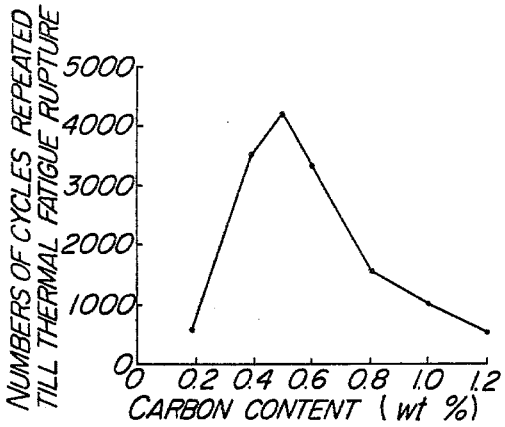
FIG. 10 is a graph showing the relationship between the number of cycles repeated till rupture and the carbon content of the nickel base alloy.

FIG. 10 shows the relationship between the number of cycles repeated till rupture and the carbon content as observed in the test conducted with the material of this example. It will be seen that the best result is obtained when the carbon content is around 0.5 wt% and that a carbon content falling within the range between 0.4 and 0.6 wt% is quite effective.

EXAMPLE 5

A test similar to that made in Example 3 was conducted with alloys containing 0.5 wt% carbon, 1.5 wt% silicon, 1.5 wt% manganese, 0.001 wt% boron, 10 wt% tungsten, 0.5 wt% yttrium, 30 wt% chromium and the remainder zirconium and nickel, and also with an alloy which contains niobium in addition to the above-mentioned constituents. The test materials were all produced by melting and casting in the atmosphere and subjected, after the casting, to a solution heat treatment at 1150° C. for four hours and an aging treatment at 982° C. for four hours.

Figure 11:
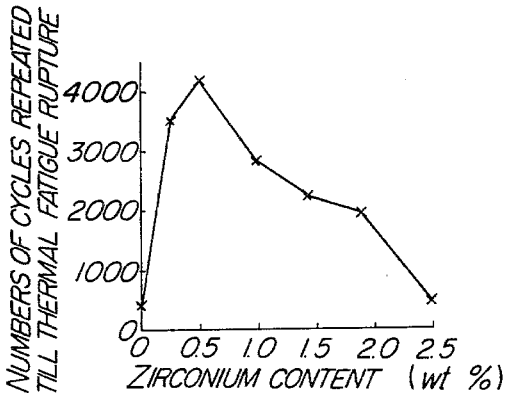
FIG. 11 is a graph showing the relationship between the number of cycles repeated till rupture and zirconium content in the thermal fatigue test.
Figure 12:
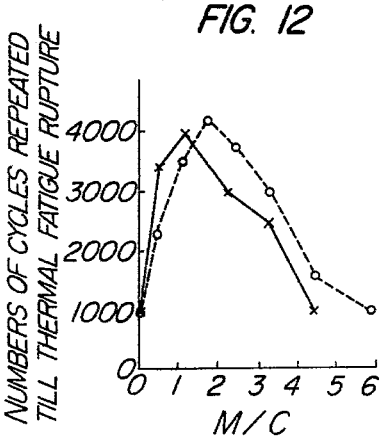
FIG. 12 is a graph showing the relationship between the number of cycles repeated till rupture and M/C (M being carbide former) as observed in the thermal fatigue test.

FIG. 11 shows the relationship between the number of cycles repeated till rupture and zirconium content as observed in the test with the alloy material containing zirconium but no niobium. It will be seen that the greatest number of cycles is obtained when the zirconium content is around 0.5 wt% and the number of cycles is drastically decreased as the zirconium content is increased and decreased from 0.5 wt%. FIG. 12 shows the relationship between the number of cycles repeated till rupture and the niobium content, as well as the relationship between the zirconium and niobium (Zr+Nb) contents and the carbon content. It will be seen that the greatest number of cycles is obtained when the ratio M/C falls within the range between 0.5 and 2.2. The number of cycles is decreased as the ratio falls out of this range.

From the foregoing description, it will be apparent that the gas turbine nozzle of the invention has greater strengths against thermal fatigue and thermal shock than those of the conventional gas turbine nozzle made of a cobalt base alloy. Also, the corrosion resistance against the combustion gas is equivalent to or greater than that of the conventional gas turbine nozzle. Further, the properties as observed in the creep rupture tests, i.e. the rupture time and reduction of area at rupture are more than or equivalent to those of the conventional gas turbine nozzle. In addition, the gas turbine nozzle material in accordance with the invention exhibits an improved weldability, so that the generation of crackings in the part repaired by welding is fairly avoided. Furthermore, it is quite advantageous that the gas turbine nozzle of the invention can be produced by welding and casting conducted in the atmosphere.

Consequently, the gas turbine nozzle of the invention exhibits a longer life than that of the conventional gas turbine nozzle made of a cobalt base alloy.

What is claimed is:

1. A gas turbine nozzle made of a cast material having a chemical composition which consists essentially of 0.2 to 1 wt% carbon, 0.1 to 2 wt% silicon, 0.1 to 2 wt% manganese, 20 to 40 wt% chromium, 0.001 to 0.1 wt% boron, 5 to 20 wt% of at least one of tungsten and molybdenum and the remainder nickel, said material having a heat-treated structure in which eutectic carbides and secondary carbides are dispersed in the matrix.

2. A gas turbine nozzle as claimed in claim 1, wherein the carbon and chromium contents are 0.4 to 0.6 wt% and 25 to 35 wt%, respectively.

3. A gas turbine nozzle made of a cast material having a chemical composition which consists essentially of 0.2 to 1 wt% carbon, 0.1 to 2 wt% silicon, 0.1 to 2 wt% manganese, 20 to 40 wt% chromium, 0.001 to 0.1 wt% boron, 5 to 20 wt% of at least one of tungsten and molybdenum, 0.1 to 2 wt% of a carbide former for forming MC type carbides and the remainder nickel, said material having a heat-treated structure in which eutectic carbides and secondary carbides are dispersed in the matrix.

4. A gas turbine nozzle as claimed in claim 3, wherein said carbide former for forming MC type carbides is zirconium.

5. A gas turbine nozzle as claimed in claim 3, wherein said carbides former for forming MC type carbide is niobium.

6. A gas turbine nozzle as claimed in claim 3, wherein the ratio M/C between the carbide former content and the carbon content falls within the range between 0.1 and 4.5.

7. A gas turbine nozzle made of a cast material having a chemical composition which consists essentially of 0.2 to 1 wt% carbon, 0.1 to 2 wt% silicon, 0.1 to 2 wt% manganese, 20 to 40 wt% chromium, 0.001 to 0.1 wt% boron, 5 to 20 wt% of at least one of tungsten and molybdenum, 0.05 to 2 wt% of at least one of yttrium and aluminum and the remainder nickel, said material having a heat-treated structure in which eutectic carbides and secondary carbides are dispersed in the matrix.

8. A gas turbine nozzle made of a cast material having a chemical composition which consists essentially of 0.2 to 1 wt% carbon, 0.1 to 2 wt% silicon, 0.1 to 2 wt% manganese, 20 to 40 wt% chromium, 0.001 to 0.1 wt% boron, 5 to 20 wt% of at least one of tungsten and molybdenum, 0.1 to 2 wt% of carbide former for forming MC type carbides, 0.05 to 2 wt% of at least one of yttrium and aluminum and the remainder nickel, said material having a heat-treated structure in which eutectic carbides and secondary carbides are dispersed in the matrix.

9. A gas turbine nozzle made of a cast material having a chemical composition which consists essentially of 0.1 to 1 wt% carbon, 0.1 to 2 wt% silicon, 0.1 to 2 wt% manganese, 20 to 40 wt% chromium, 0.001 to 0.1 wt% boron, 5 to 20 wt% of at least one of tungsten and molybdenum, 5 to 15 wt% cobalt and the remainder nickel, said material having a heat-treated structure in which eutectic carbides and secondary carbides are dispersed in the matrix.

10. A gas turbine nozzle made of a cast material having a chemical composition which consists essentially of 0.1 to 1 wt% carbon, 0.1 to 2 wt% silicon, 0.1 to 2 wt% manganese, 20 to 40 wt% chromium, 0.001 to 0.1 wt% boron, 5 to 20 wt% of at least one of tungsten and molybdenum, 0.1 to 2 wt% of a carbide former for forming MC type carbides, 5 to 15 wt% cobalt and the remainder nickel, said material having a heat-treated structure in which eutectic carbides and secondary carbides are dispersed in the matrix.

11. A gas turbine nozzle made of a cast material having a chemical composition which consists essentially of 0.1 to 1 wt% carbon, 0.1 to 2 wt% silicon, 0.1 to 2 wt% manganese, 20 to 40 wt% chromium, 0.001 to 0.1 wt% boron, 5 to 20 wt% of at least one of tungsten and molybdenum, 0.1 to 2 wt% of carbide former for forming MC type carbides, 0.05 to 2 wt% of at least one of yttrium and aluminum, 5 to 15 wt% cobalt and the remainder nickel, said material having a heat-treated structure in which eutectic carbides and secondary carbides are dispersed in the matrix.

12. A gas turbine nozzle as claimed in one of claims 3, 6, 8, 10 and 11, wherein said carbide former is selected from the group consisting of titanium, niobium, hafnium, tantalum, zirconium and vanadium.

13. A gas turbine nozzle as claimed in one of claims 1, 3, 7, 8, 9, 10 and 11, wherein said eutectic carbides are dispersed in the matrix in lumps.

* * * * *